US010175610B2

(12) United States Patent
Suzuki

(10) Patent No.: US 10,175,610 B2
(45) Date of Patent: Jan. 8, 2019

(54) DEVELOPING DEVICE HAVING TONER CONTENT DETECTION

(71) Applicant: CANON KABUSHIKI KAISHA, Tokyo (JP)

(72) Inventor: Shinya Suzuki, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/446,339

(22) Filed: Mar. 1, 2017

(65) Prior Publication Data

US 2017/0255129 A1 Sep. 7, 2017

(30) Foreign Application Priority Data

Mar. 2, 2016 (JP) ..... 2016-040381

(51) Int. Cl.
*G03G 15/08* (2006.01)
*G03G 15/09* (2006.01)

(52) U.S. Cl.
CPC ..... *G03G 15/0891* (2013.01); *G03G 15/0853* (2013.01); *G03G 15/0893* (2013.01); *G03G 15/09* (2013.01); *G03G 2215/0838* (2013.01)

(58) Field of Classification Search
CPC ..... G03G 15/0829; G03G 15/0853; G03G 15/0893; G03G 2215/0822; G03G 2215/0838; G03G 2215/0888
USPC ..... 399/30, 63
See application file for complete search history.

(56) References Cited

U.S. PATENT DOCUMENTS 4,147,127 A * 4/1979 Terashima ..... G03G 15/0853 118/689
4,240,375 A * 12/1980 Terashima ..... G03G 15/0853 118/690
4,405,226 A * 9/1983 Kimura ..... G03G 15/0853 118/689
4,583,491 A 4/1986 Suzuki
5,418,432 A 5/1995 Takeuchi et al.
6,249,664 B1 * 6/2001 Sato ..... G03G 15/0822 399/254

(Continued)

FOREIGN PATENT DOCUMENTS

JP 55055369 A * 4/1980
JP 59045470 A * 3/1984 ..... G03G 15/0853

(Continued)

*Primary Examiner* — Robert Beatty
(74) *Attorney, Agent, or Firm* — Venable LLP

(57) ABSTRACT

A developing device includes a rotatable developer carrying member, first and second chambers configured to accommodate developer supplied to the developer carrying member, and first and second rotatable feeding members provided in the first and second chambers, respectively. A first communication port permits feeding of the developer from the second chamber to the first chamber, and a second communication port permits feeding of the developer from the first chamber to the second chamber. In addition, a toner content detecting portion includes a planar detecting surface including at least a planar coil generating a magnetic field and detects the toner content. The detecting surface is provided in the first communication port above a bottom of the first communication port and is disposed substantially in a central portion of the first communication port.

17 Claims, 10 Drawing Sheets

(56) References Cited

U.S. PATENT DOCUMENTS

| | | | | |
|---|---|---|---|---|
| 8,005,386 | B2 | 8/2011 | Suzuki | |
| 8,688,014 | B2 | 4/2014 | Shigehiro | |
| 9,170,233 | B2 * | 10/2015 | Hirota | G01N 27/72 |
| 2011/0262161 | A1 | 10/2011 | Fukuda et al. | |
| 2015/0086229 | A1 * | 3/2015 | Naruse | G03G 15/0825 399/30 |

FOREIGN PATENT DOCUMENTS

| | | | | |
|---|---|---|---|---|
| JP | S60-39672 | A | | 3/1985 |
| JP | H06-76961 | A | | 3/1994 |
| JP | 2007065123 | A | * | 3/2007 |
| JP | 2008-203064 | A | | 9/2008 |
| JP | 2012-014034 | A | | 1/2012 |
| JP | 2012-185381 | A | | 9/2012 |
| JP | 2013105037 | A | * | 5/2013 |

* cited by examiner

DEVELOPING DEVICE HAVING TONER CONTENT DETECTION

FIELD OF THE INVENTION AND RELATED ART

The present invention relates to a developing device suitable for an image forming apparatus, using electrophotography, such as a copying machine, a printer, a facsimile machine or a multi-function machine.

In the developing device used in the image forming apparatus such as the copying machine, the printer, the facsimile machine or the multi-function machine, a two-component developer consisting of non-magnetic toner and a magnetic carrier (hereinafter, the developer is simply referred to as a developer) is used. The toner contained in the developer is consumed by being subjected to development, and therefore a toner content of the developer in a developing container lowers with use for a long time. However, when the toner content of the developer is not maintained within a roller range, image defect can generate during image formation. Therefore, a developing device capable of maintaining the toner content of the developer subjected to development within the predetermined range of supplying toner (specifically a supply agent) in a predetermined amount depending on the toner content of the developer in the developing container has been known.

Recently, an inductance sensor has been used for detecting the toner content of the developer. The inductance sensor includes an LC oscillation circuit including a coil capable of generating a magnetic field depending on energization and causes the coil to generate the magnetic field, so that a change in magnetic field depending on permeability of the developer is detected by the LC oscillation circuit. As the inductance sensor, one in which a helical coil is formed on a substrate by a print pattern has been known (Japanese Laid-Open Utility Model Application Hei06-76961). Further, there is an inductance sensor where a helical coil is formed in multiple layers by a print pattern and thus the number of windings of the coil is increased without changing an area of the coil, with the result that an improvement in detection sensitivity of a sensor is realized (Japanese Laid-Open Patent Application (JP-A) 2008-203064).

These inductance sensors have been proposed on an inner wall surface or an outer wall surface of the developing container so that one surface of a detecting member (part of the substrate) where the coil is formed contacts the developer. However, in this case, although the magnetic field penetrating through the substrate is generated by the coil depending on the energization, i.e., the magnetic field generates on both surfaces (both sides) of the detecting member, the change in magnetic field is detected only at one surface of the detecting member, and therefore the detection sensitivity of the sensor is liable to be lower. Further, an amount of the developer to be detected is small by the detection at one surface, and therefore detection accuracy of the sensor is liable to be lower. Therefore, a developing device in which the inductance sensor is provided for partitioning an inside of a developing container into a developing chamber and a stirring chamber and thus a change in magnetic field can be detected at both surfaces of the detecting member has been conventionally proposed (JP-A 2012-14034).

However, in a conventional developing device disclosed in JP-A 2012-14034, one surface of the detecting member contacts the developer in the developing chamber and the other surface of the detecting member contacts the developer in the stirring chamber thereby to detect the change in magnetic field, and therefore a detection result is liable to change by the influence of toner content (density) non-uniformity which can vary depending on each of the chambers. Therefore, in the conventional developing devices, the toner content of the developer was not able to be property detected, with the result that it was difficult to maintain the toner content within the predetermined range.

SUMMARY OF THE INVENTION

The present invention has been accomplished in view of the above-described problem, a principal object of the present invention is to provide a developing device capable of properly detecting a toner content of a developer through improvements in detection sensitivity and detection accuracy of a sensor in the case where an inductance sensor including a planar coil is used.

A specific object of the present invention is to provide a developing device improved in detection accuracy of the sensor in the case where the inductance sensor including the planar coil is used.

According to an aspect of the present invention, there is provided a developing device comprising: a rotatable developer carrying member configured to carry a developer containing non-magnetic toner and a magnetic carrier; first and second chambers configured to accommodate the developer supplied to the developer carrying member; a first rotatable feeding member provided in the first chamber and configured to feed the developer in a first direction; a second rotatable feeding member provided in the second chamber and configured to feed the developer in a second direction opposite to the first direction; a first communication port configured to permit feeding of the developer from the second chamber to the first chamber; a second communication port configured to permit feeding of the developer from the first chamber to the second chamber; and a toner content detecting portion including a planar detecting surface including at least a planar coil generating a magnetic field and configured to detect the toner content, wherein the detecting surface is provided in a region of the first communication port sandwiched between a rotational axis of the first rotatable feeding member and a rotational axis of the second rotatable feeding member and is disposed at a position such that the developer is fed toward both sides of the toner content detecting portion in a direction in which the detecting surface crosses the first direction.

Further features of the present invention will become apparent from the following description of exemplary embodiments with reference to the attached drawings.

DESCRIPTION OF THE EMBODIMENTS

Figure 1:
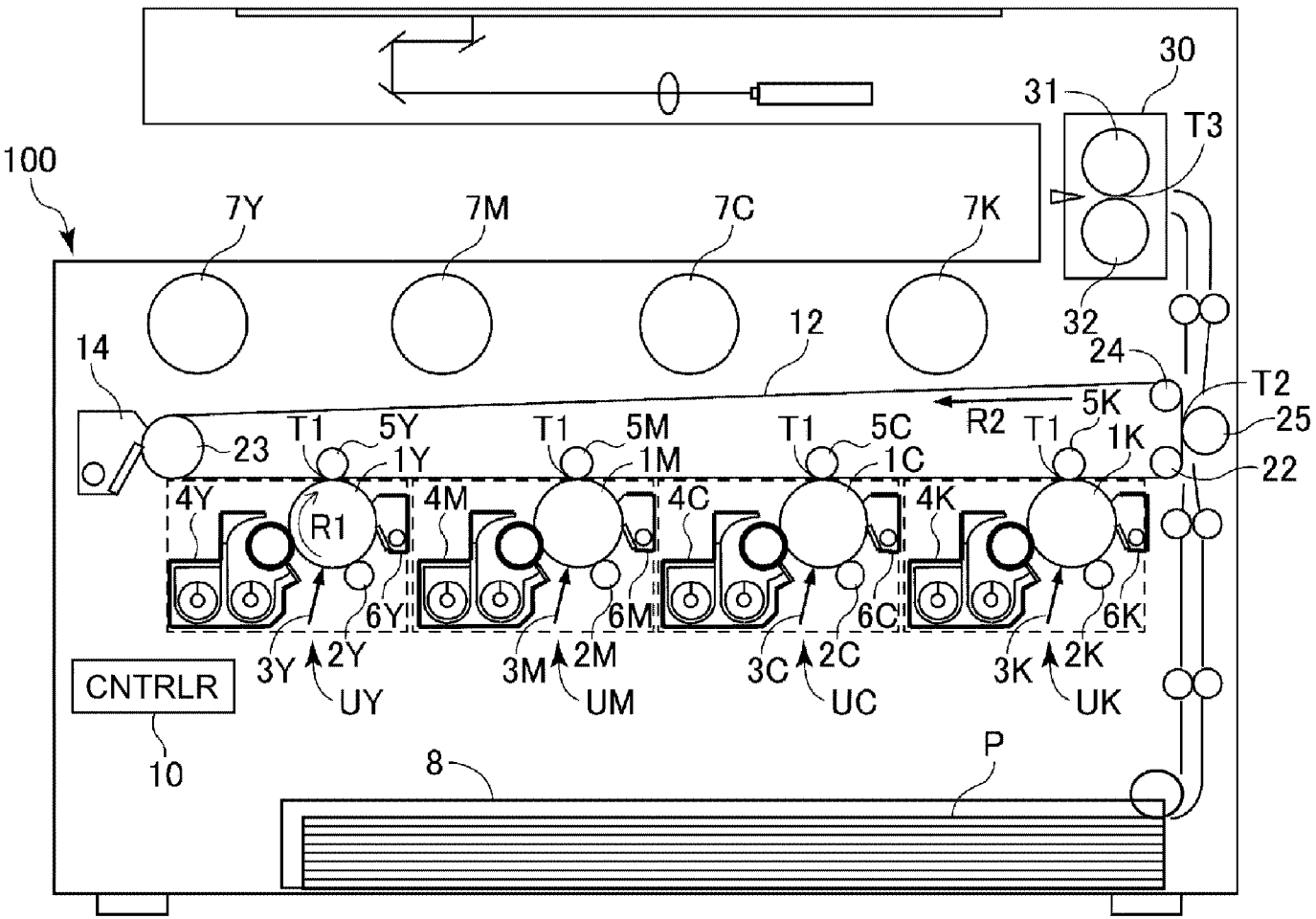
FIG. 1 is a schematic illustration of a structure of an image forming apparatus to which a developing device according to an embodiment of the present invention is applied.

A developing device according to an embodiment of the present invention will be described. First, a general structure of an image forming apparatus to which the developing device according to the present invention is applied will be described with reference to FIGS. 1 to 4. An image forming apparatus 100 shown in FIG. 1 is an intermediary transfer type full-color printer of a tandem type in which image forming portions UY, UM, UC and UK are arranged along an intermediary transfer belt 12.

<Image Forming Apparatus>

At the image forming portion UY, a yellow toner image is formed on a photosensitive drum 1Y and then is transferred onto the intermediary transfer belt 12. At the image forming portion UM, a magenta toner image is formed on a photosensitive drum 1M and then is transferred onto the intermediary transfer belt 12. At the image forming portion UC and UK, cyan and black toner images are formed on photosensitive drums 1C and 1K respectively, and then are transferred onto the intermediary transfer belt 121. The four color toner images transferred on the intermediary transfer belt 12 are fed to a secondary transfer portion T2 and are secondary-transferred collectively onto a recording material P (sheet material such as a sheet or an OHP sheet). The recording material P is taken out from a cassette 8 one by one and is fed to the secondary transfer portion T2.

The image forming portions UY, UM, UC and UK have the substantially same construction except that colors of toners used in developing devices 4Y, 4M, 4C and 4K, respectively, are yellow, magenta, cyan and black, respectively. The following constituents of the image forming portions are represented by reference numerals or symbols from which suffixes Y, M, C and K for representing a difference in color for the image forming portions UY, UM, UC and UK are omitted, and constitutions and operations of the image forming portions UY to UK will be described.

The image forming portion U includes, at a periphery of the photosensitive drum 1 as an image bearing member, a charging roller 2, an exposure device 3, the developing device 4, a primary transfer roller 5 and a drum cleaning device 6. The photosensitive drum 1 is prepared by forming a photosensitive layer on an outer peripheral surface of an aluminum cylinder, and is rotated in an arrow R1 direction at a predetermined process speed.

Figure 3:
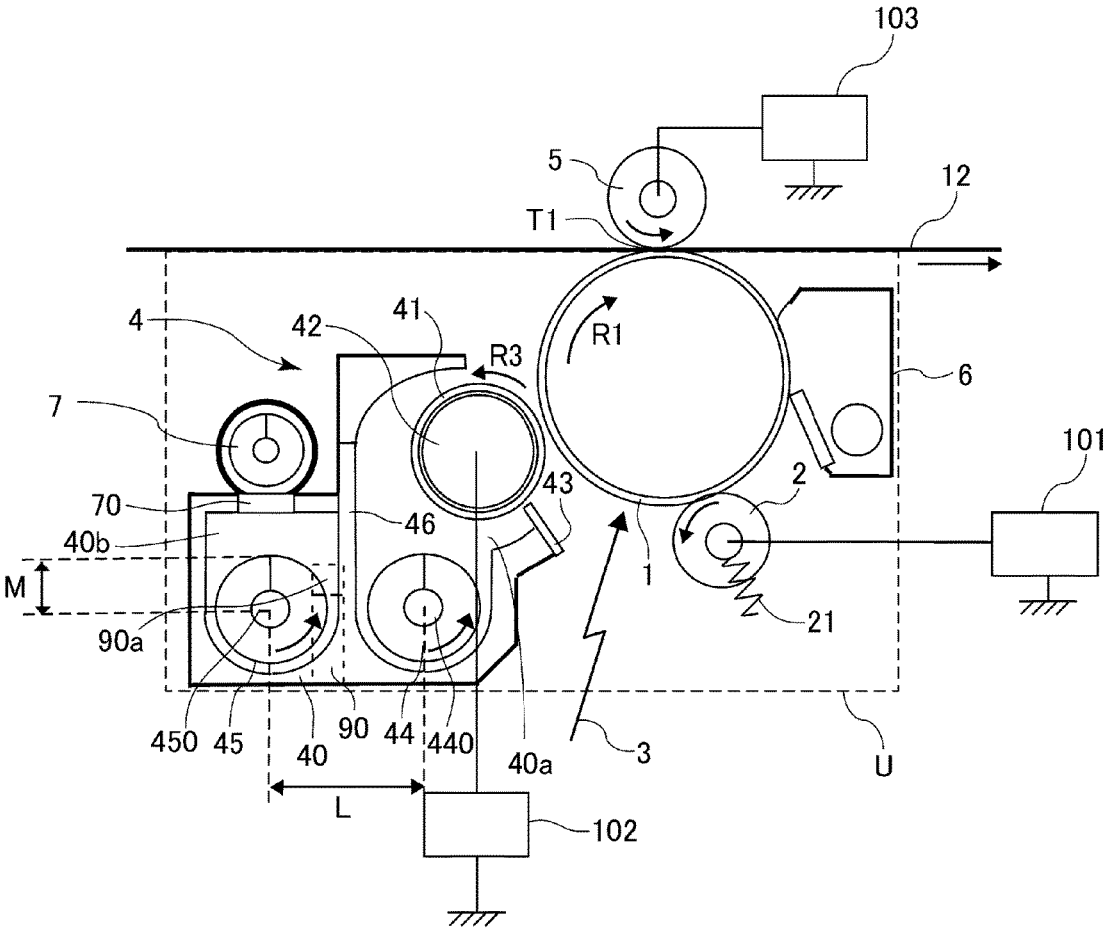
FIG. 3 is a sectional view showing a structure of the developing device in cross section perpendicular to a shaft (axis).

The charging roller 2 is, as shown in FIG. 3, urged toward the photosensitive drum 1 by an urging spring 21 and is press-contacted to a surface of the photosensitive drum 1. As a result, the charging roller 2 is rotated by rotation of the photosensitive drum 1. Then, the charging roller 2 electrically charges the photosensitive drum 1 to a uniform negative dark portion potential in contact with the photosensitive drum 1 under application of a charging voltage by a high-voltage source 101. Specifically, to the charging roller 2, as the charging voltage, an oscillating voltage in the form of, e.g., a DC voltage of −500 V biased with an AC voltage of sine wave of 0.92 kHz in frequency and 1.5 kV in peak-to-peak voltage is applied, so that the surface of the photosensitive drum 1 is uniformly charged to the dark portion potential of −500 V.

The exposure device 3 generates a laser beam, from a laser beam emitting element, obtained by subjecting scanning line image data which is developed from an associated color component image to ON-OFF modulation and then to scanning through a rotating mirror, so that an electrostatic latent image for an image is formed on the surface of the charged photosensitive drum 1. The developing device 4 supplies the toner to the photosensitive drum 1 and develops the electrostatic latent image into the toner image. The developing device 4 will be specifically described later (FIG. 3).

The primary transfer roller 5 is, as shown in FIG. 3, disposed opposed to the photosensitive drum 1 via the intermediary transfer belt 12 and forms a toner image primary transfer nip (portion) T1 between the photosensitive drum 1 and the intermediary transfer belt 12. By applying a primary transfer voltage from a high-voltage source 103 to the primary transfer roller 5 at the primary transfer nip T1, the toner image is primary-transferred from the photosensitive drum 1 onto the intermediary transfer belt 12. As the primary transfer voltage, e.g., a DC voltage of +800 V is applied. The drum cleaning device 6 rubs the photosensitive drum 1 with a cleaning blade and removes a primary transfer residual toner slightly remaining on the photosensitive drum 1 after the primary transfer.

The intermediary transfer belt 12 is, as shown in FIG. 1, extended around and supported by a driving roller 22, a tension roller 23, an inner secondary transfer roller 24 and the like, and is driven by the driving roller 22, so that the intermediary transfer belt 12 is rotated in an arrow R2 direction in FIG. 1. A secondary transfer portion T2 is a toner image transfer nip onto a recording material P formed by contact of an outer secondary transfer roller 25 with the intermediary transfer belt 12 stretched by the inner secondary transfer roller 24. At the secondary transfer portion T2, by applying a secondary transfer voltage to the outer secondary transfer roller 25, the toner image is secondary-transferred from the intermediary transfer belt 12 onto the recording material P fed to the secondary transfer portion T2. A secondary transfer residual toner remaining on the intermediary transfer belt 12 while being deposited on the intermediary transfer belt 12 is removed by a belt cleaning device 14. The belt cleaning device 14 removes the secondary transfer residual toner by rubbing the intermediary transfer belt 12 with a cleaning blade.

The recording material P on which the four color images are secondary-transferred at the secondary transfer portion T2 is fed to a fixing device 30. The fixing device 30 forms a fixing nip T3 by contact between fixing rollers 31 and 32, and at the fixing nip T3, the toner image is fixed on the recording material P while feeding the recording material P. In the fixing device 30, the fixing nip T3 is formed by causing the fixing roller 32 to be press-contacted by an urging mechanism (not shown) to the fixing roller 31 heated from an inside by a lamp heater (not shown). By nipping and feeding the recording material P at the fixing nip T3, the toner image is heated and pressed, so that the toner image is fixed on the recording material P. The recording material P on which the toner image is fixed by the fixing device 30 is discharged to an outside of the image forming apparatus 100.

A toner supplying device 7 is capable of supplying, to the developing device 4, the toner in an amount corresponding to an amount of the toner consumed depending on consumption of the toner in the developing device 4 with image formation. In this embodiment, as the developer, a two-component developer containing non-magnetic toner having a negatively chargeable characteristic and a magnetic carrier having a positively chargeable characteristic is used. In the developing device 4 (specifically in a developing container), for example, about 250 g of the two-component developer having a toner content (proportion (ratio) of a weight of the toner to a total weight of the developer and this ratio is also called as a TD ratio) of about 8%, in which the toner and the carrier are mixed at a proportion of about 8:92 as a weight ratio, is accommodated.

<Two-Component Developer>

The two-component developer will be described. The two-component developer contains the non-magnetic toner and the magnetic carrier. The non-magnetic toner includes a colored resin particles containing a binder resin such as styrene-based resin or a polyester resin, a colorant such as carbon black, a dye or a pigment, and another additive as desired and includes colored particles to which an external additive such as colloidal silica fine powder is externally added. The toner may preferably have a volume-average particle size of 4 μm-10 μm, more preferably about 6 μm. On the other hand, as the magnetic carrier, for example, surface-oxidized or unoxidized metals such as iron, cobalt, manganese, nickel, chromium, rare-earth element, and alloys of these metals, or oxide ferrite can be suitably used. The carrier may preferably have a volume-average particle size of 20-60 μm, more preferably about 30-50 μm.

<Controller>

Figure 2:
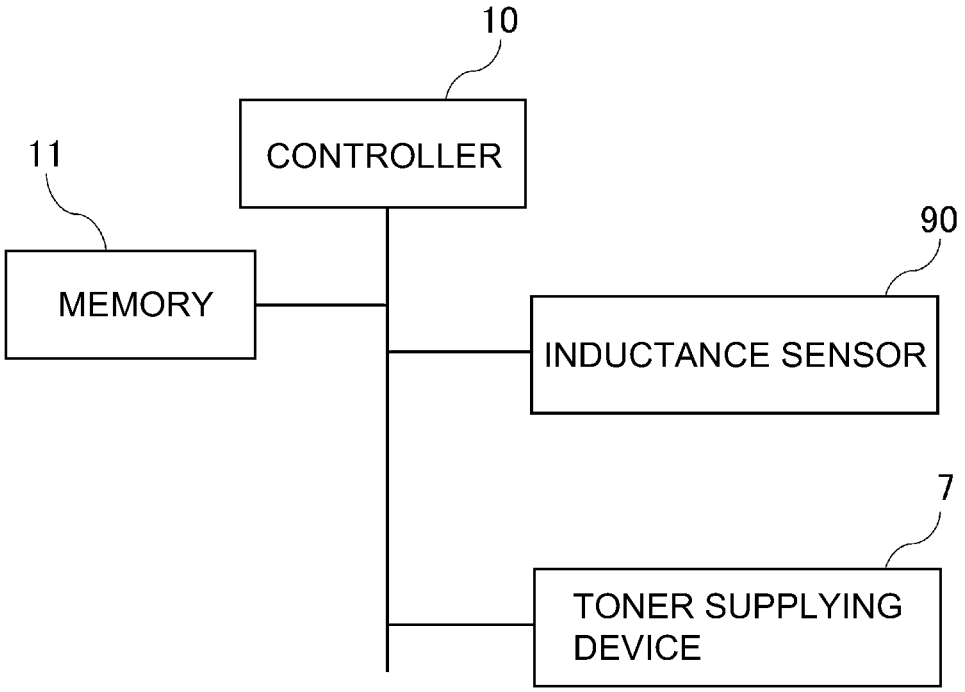
FIG. 2 is a control block diagram showing a toner supply control system.

The image forming apparatus 100 includes a controller 10. The controller 10 is, e.g., a CPU or the like for effecting various pieces of control of the image forming apparatus 100, such as image formation control. In this embodiment, the controller will be described with reference to FIG. 2. FIG. 2 is a control block diagram showing a toner supply control system. As shown in FIG. 2, with the controller 10, a memory 11, an inductance sensor 90 and the toner supplying device 7 are connected via an unshown interface. Incidentally, the controller 10 is capable of controlling above-described respective portions (FIG. 1) other than the portions shown in FIG. 2, but are omitted from illustration and description since such portions are not directed to the principal object of the present invention.

The memory 11 is ROM, RAM or a hard disk. In the memory 11, e.g., various control programs for image formation control and toner supply control, and various data and the like are stored in advance. As the various data, data (e.g., unshown tables) or the like of a toner content associated with a detection signal of the inductance sensor 90 described later are stored. Further, in the memory 11, a calculation (computation) result or the like with execution of the various control programs can be temporarily stored. The controller 10 is capable of executing the various control programs stored in the memory 11 and controls the image forming apparatus 100 with the execution of the control programs. For example, the controller 10 is capable of effecting control of various operations such as image formation by the image forming portions UY-UK, primary transfer of the toner images onto the intermediary transfer belt 12, secondary transfer of the toner images onto the recording material P, feeding of the recording material P and supply of the toner by the toner supplying device 7.

The controller 10 is capable of acquiring (receiving) a detection signal of the inductance sensor 90 during the toner supply control. The inductance sensor 90 will be described later (with reference to FIGS. 5-8). The controller 10 controls the toner supplying device 7 so as to supply the toner to the developing device 4 in a required supply amount depending on the toner content of the developer on the basis of the detection signal acquired from the inductance sensor 90 during the execution of the toner supply control. As a result, the toner content of the developer accommodated in the developing device 4 (specifically in a developing container 40) is maintained at a density (toner content) (e.g., about 7-9%) within a predetermined range close to that in an initial state.

<Developing Device>

The developing device 4 will be described using FIGS. 3 and 4. The developing device 4 shown in FIG. 3 is of a horizontal stirring type in which a developing chamber 40*a* and a stirring chamber 40*b* are horizontally provided. The developing device 4 includes the developing container 40 forming a housing, a developing sleeve 41 as a developer carrying member and the regulating blade 43 as a regulating member are provided. In the developing container 40, the two-component developer containing the toner and the carrier is accommodated. Incidentally, in FIG. 4, for convenience of illustration, the inductance sensor 90 described later is omitted from illustration.

As shown in FIG. 3, the developing sleeve 41 is partly exposed through an opening of the developing container 40 provided at a position opposing the photosensitive drum 1 and is provided rotatably in the developing container 40. The developing sleeve 41 is formed in a cylindrical shape using a non-magnetic material such as aluminum or stainless steel, and inside the developing sleeve 41, a magnet roller 42 is fixedly provided. By a magnetic force of the magnet roller 42, on the surface of the developing sleeve 41, a magnetic chain (magnetic brush) of the developer is formed. A layer thickness of the magnetic chain formed on the surface of the developing sleeve 41 is regulated by the plate-like regulating blade 25 43 changed by the non-magnetic material.

The developing sleeve 41 rotates in an arrow R3 direction while carrying the developer regulated in layer thickness by the regulating blade 43, and thus feeds the developer to the photosensitive drum 1 while rubbing the photosensitive drum 1 with the magnetic chain of the developer.

To the developing sleeve 41, a developing voltage in the form of a DC voltage biased with an AC voltage is applied from a high-voltage source 102. Specifically, an oscillating voltage in the form of a DC voltage of −350 V biased with an AC voltage of a rectangular wave of 1800 V in peak-to-peak voltage and 8.0 kHz in frequency is applied. As a result, the toner is supplied to the electrostatic latent image formed on the photosensitive drum 1, so that the electrostatic latent image is developed into the toner image.

An inside of the developing container 40 is partitioned, as shown in FIG. 3, with respect to a horizontal direction into a right-side developing chamber 40*a* and a left-side stirring chamber 40*b* by a partition wall 46 extending in a vertical direction at a substantially central portion. As shown in FIG. 4, the developing chamber 40*a* and the stirring chamber 40*b* communicate with each other through first and second communicating portions 401 and 402, as delivering portions, provided at both end portions of the partition wall 46, and form a circulation path of the developer.

In chambers consisting of the developing chamber 40*a* as a first chamber and the stirring chamber 40*b* as a second chamber, a developing screw 44 and a stirring screw 45 are rotatably provided. Each of the developing screw 44 and the stirring screw 45 has a screw structure including a blade formed spirally around a rotation shaft. Therefore, by rotation of the developing screw 44 and the stirring screw 45, the developer is circulated and fed in the developing container 40 while being stirred. With the feeding of the developer while stirring the developer, the toner is negatively charged and the carrier is positively charged.

Figure 4:
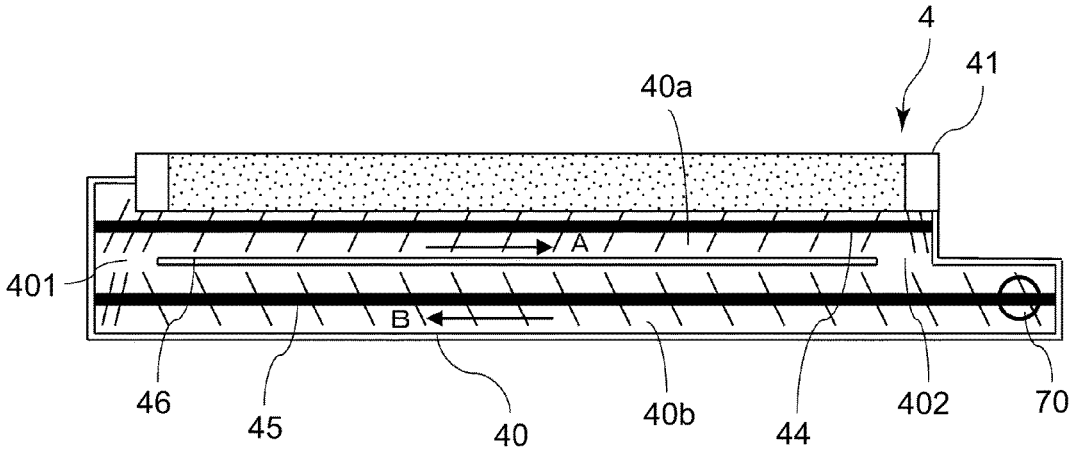
FIG. 4 is a top view showing a structure of the developing device in a horizontal cross-section including an axial direction.

As shown in FIG. 4, the developing screw 44 is disposed substantially in parallel with the developing sleeve 41 along the rotation shaft of the developing sleeve 41 in the developing chamber 40*a*, and the stirring screw 45 is disposed substantially in parallel with the developing screw 44 in the stirring chamber 40*b*. When the developing screw 44 as a first rotatable feeding member (first feeding screw) rotates, the developer in the developing chamber 40*a* fed in one direction from left to right in FIG. 4 along the rotation shaft of the developing screw 44 (arrow A in the figure). The developer fed toward a downstream side of the developing chamber 40*a* with respect to a developer feeding direction is delivered from the developing container 40*a* to the stirring chamber 40*b* through the second communicating portion 402 as a second delivering portion. On the other hand, when the stirring screw 45 as a second developing member (second feeding screw) rotates, the developer in the stirring chamber 40*b* is fed in the other direction from right to left in FIG. 4 along the rotation shaft of the stirring screw 45 (arrow B in the figure), i.e., an opposite direction to the developer feeding direction in the developing chamber 40*a*. The developer fed toward a downstream side of the stirring chamber 40*b* with respect to the developer feeding direction is delivered from the stirring chamber 40*b* to the developing chamber 40*a* through the first communicating portion 401 as a first delivering portion. In this manner, the developer fed by rotation of the developing screw 44 and the stirring screw 45 is circulated and fed between the developing chamber 40*a* and the stirring chamber 40*b* through the first and second communicating portions 401 and 402 provided at the both end portions of the partition wall 46.

At an upper portion of the stirring chamber 40*b* in an upstream side of the stirring chamber 40*b* with respect to the developer feeding direction, a supply opening 70 is provided, and with the supply opening 70, the toner supplying device 7 is connected (FIG. 3). The toner supplied from the toner supplying device 7 to the stirring chamber 40*b* through the supplying opening 70 is fed toward a downstream side with respect to the developer feeding direction by the stirring screw 45. An amount of the toner supplied from the toner supplying device 7 to the stirring chamber 40*b* is determined by the controller 10 (FIG. 2) on the basis of a detection signal of the inductance sensor 90 provided in the developing container 40. The controller 10 controls the toner supplying device 7 so that the toner in a supply in which the toner content of the developer accommodated in the developing container 40 is about 7-9% is supplied in accordance with the toner content based on the detection signal of the inductance sensor 90. In this way, the toner in an amount substantially equal to an amount of the toner consumed with the image formation is supplied.

<Inductance Sensor>

In this embodiment, in order to detect the toner content of the developer accommodated in the developing container 40, the inductance sensor 90 is used. The inductance sensor 90 as a detecting means is a magnetic permeability sensor capable of outputting, as a detection signal, a voltage value depending on magnetic permeability of the developer by using an inductance of a coil. That is, the inductance sensor 90 includes the coil, and the inductance of the coil changes depending on the (magnetic) permeability of the developer. In the inductance sensor 90, in the case where the toner content of the developer is small, a proportion of the magnetic carrier contained in the developer in a unit volume becomes large and apparent permeability of the developer becomes high, so that the voltage value (peak voltage) becomes high. On the other hand, in the case where the toner content of the developer is large, the proportion of the magnetic carrier contained in the developer in the unit volume becomes small and the apparent permeability of the developer becomes low, so that the voltage value becomes low.

Further, as regards the inductance sensor 90, even when the toner content of the developer is unchanged, the voltage value changes when a bulk density of the developer changes. In the case where the bulk density of the developer is high, a density of the magnetic carrier contained in the developer in the unit volume becomes high and the apparent permeability of the developer becomes high, so that the voltage value becomes high. On the other hand, in the case where the bulk density of the developer is low, the density of the magnetic carrier contained in the developer in the unit volume becomes low and the apparent permeability of the developer becomes low, so that the voltage value becomes low.

The reason why the above-described inductance sensor 90 is used is that the coil can be formed easily by print-wiring a lead wire on a substrate and that downsizing and cost reduction of the sensor and simplification of quality control are easily realized. The inductance sensor 90 used in this embodiment will be described using FIGS. 5-8.

Figure 5:
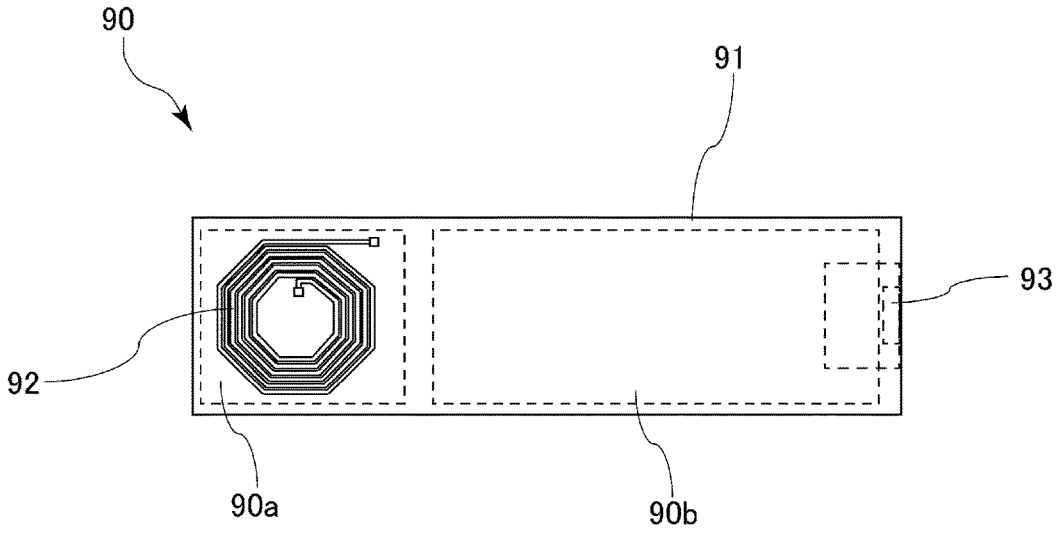
FIG. 5 is a schematic view showing an inductance sensor.
Figure 6:
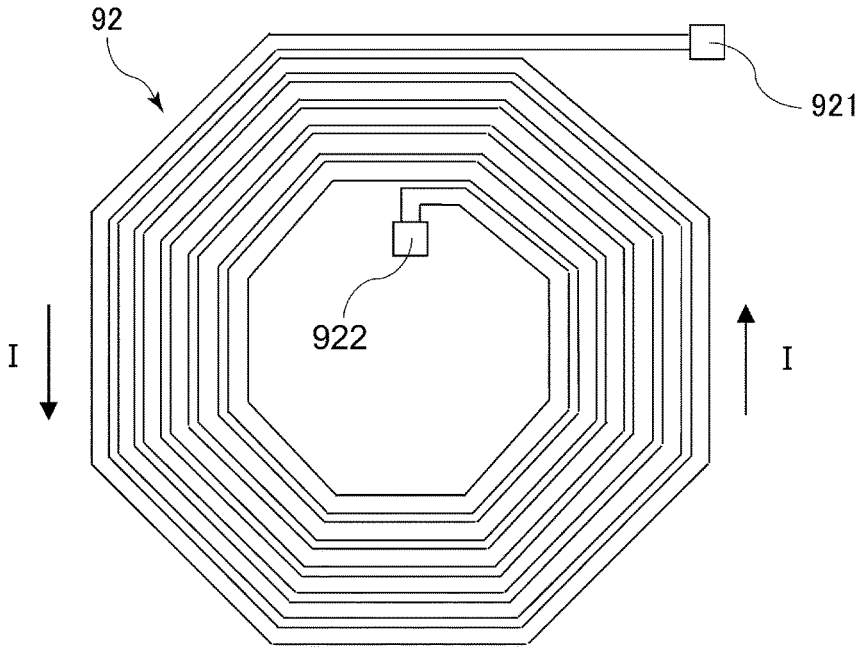
FIG. 6 is a schematic view showing a planar coil of the sensor of one surface type.

The inductance sensor 90 shown in FIG. 5 is a sensor of one-surface type in which a planar coil 92 is formed on only one surface of a printed board (substrate) 91. As shown in FIG. 5, the inductance sensor 90 as the detecting means is formed in a plate shape and can be roughly divided into a detecting portion 90*a* and a circuit portion 90*b*. At the detecting portion 90*a*, the planar coil 92 is formed. The planar coil 92 is formed, e.g., in an octagonal shape which is 6 mm in outer diameter and which is a counterclockwise spiral shape as shown in FIG. 6, by a print pattern on one surface of the printed board 91.

Figure 7:
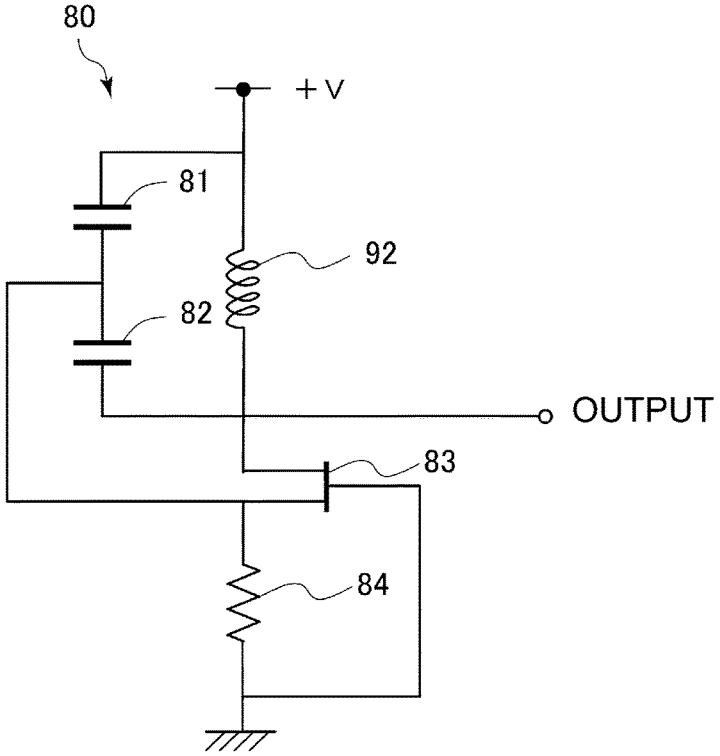
FIG. 7 is a circuit view showing an LC oscillation circuit.

The circuit portion 90*b* is, as shown in FIG. 5, formed on a surface in a side opposite from the surface where the planar coil 92 is formed, for example. Further, the detecting portion 90*a* and the circuit portion 90*b* form an LC oscillation circuit 80 as shown in FIG. 7. That is, the circuit portion 90*b* includes electronic parts (transistor, resistor, capacitor and the like), of the LC oscillation circuit 80 (FIG. 7), other than the planar coil 92, and is electrically connected with end portions 921 and 922 (FIG. 6) of the planar coil 92.

FIG. 7 shows the LC oscillation circuit 80. The LC oscillation circuit 80 shown in FIG. 7 includes, in addition to the planar coil 92, electronic parts such as two capacitors (81, 82), a transistor 83 and a resistor 84. An oscillating frequency "f" of this LC oscillation circuit 80 is represented by the following formula 1.

$$f=1/2\pi(LC)^{1/2} \qquad \text{formula 1}$$

In the formula 1, C=(C1×C2)/(C1+C2), L is the inductance of the planar coil 92, C1 is the capacitance of the capacitor 81, and C2 is the capacitance of the capacitor 82.

Figure 8:
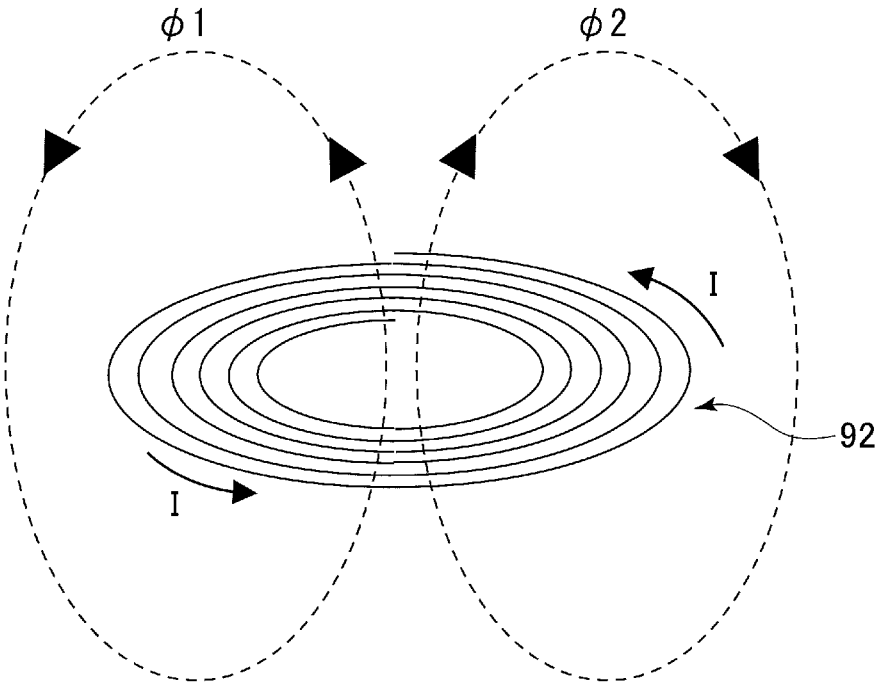
FIG. 8 is a schematic view for illustrating a magnetic field generated by the developing container depending on energization.

Further, as shown in FIG. 5, the printed board 91 is provided with a connector 93, connectable with a power source (not shown), in an end portion side remote from the detecting portion 90*a* with respect to a longitudinal direction, so that a current can be supplied from the power source connected with the connector 93 to the LC oscillation circuit 80 (FIG. 7). When the current flows through the planar coil 92, the planar coil 92 generates a magnetic field. FIG. 8 shows the magnetic field generated by the planar coil 92 depending on energization.

As shown in FIG. 8, in the case where the current is caused to flow through the planar coil 92 in a direction of an arrow indicated by a solid line in the figure (in this embodiment, the counterclockwise direction), the planar coil 92 generates a magnetic field φ1 and a magnetic field φ2. The magnetic field φ1 and the magnetic field φ2 extends from below toward above in the neighborhood of a center of the planar coil 92 and extends from above toward below in an outside of the planar coil 92. That is, the magnetic field φ1 and the magnetic field φ2 penetrate through the printed board 91 and generate on both surfaces (both sides) of the detecting portion 90*a* (FIG. 5) where the planar coil 92 is formed.

The permeability of the developer containing the non-magnetic toner and the magnetic carrier varies moment to moment depending on the toner content. In the case where the developer contacts the planar coil 92, the developer has the influence on the magnetic field generated by the planar coil 92. At this time, depending on the permeability of the developer, a magnitude of the influence of the permeability of the developer on the magnetic field, and therefore when the permeability of the developer is changed, the inductance of the planar coil 92 can change. When the inductance of the planar coil 92 changes, the above-described oscillating frequency changes (formula 1), so that a voltage value outputted from the inductance sensor 90 changes.

Figure 12:
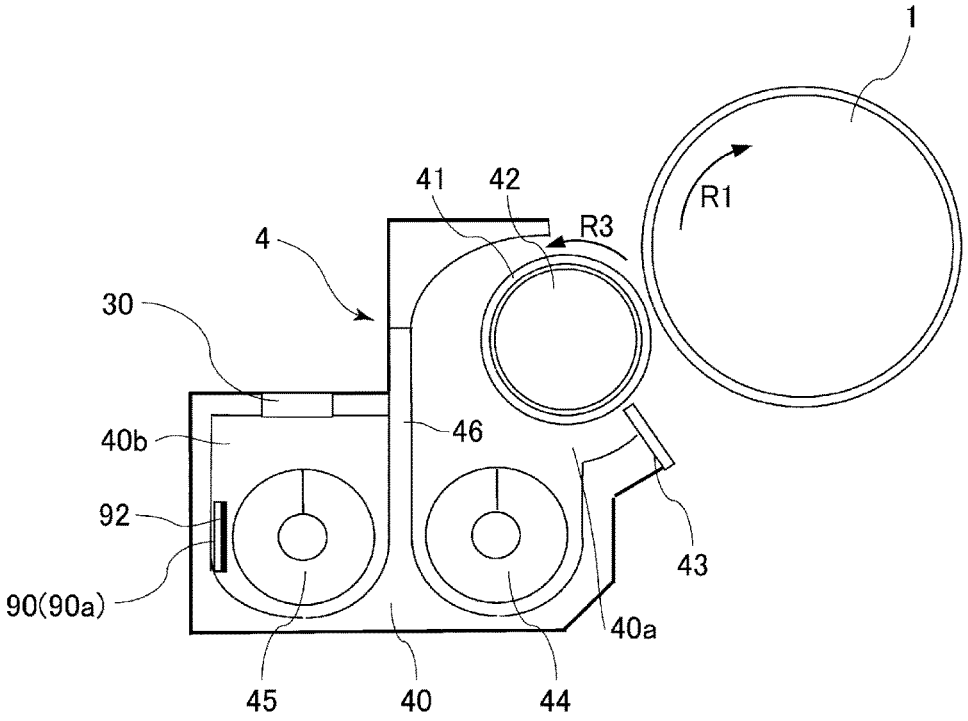
Fig. 12 (Prior Art)
FIG. 12 is a sectional view for illustrating a sensor arrangement in a developing device in Conventional Example 1.
Figure 13:
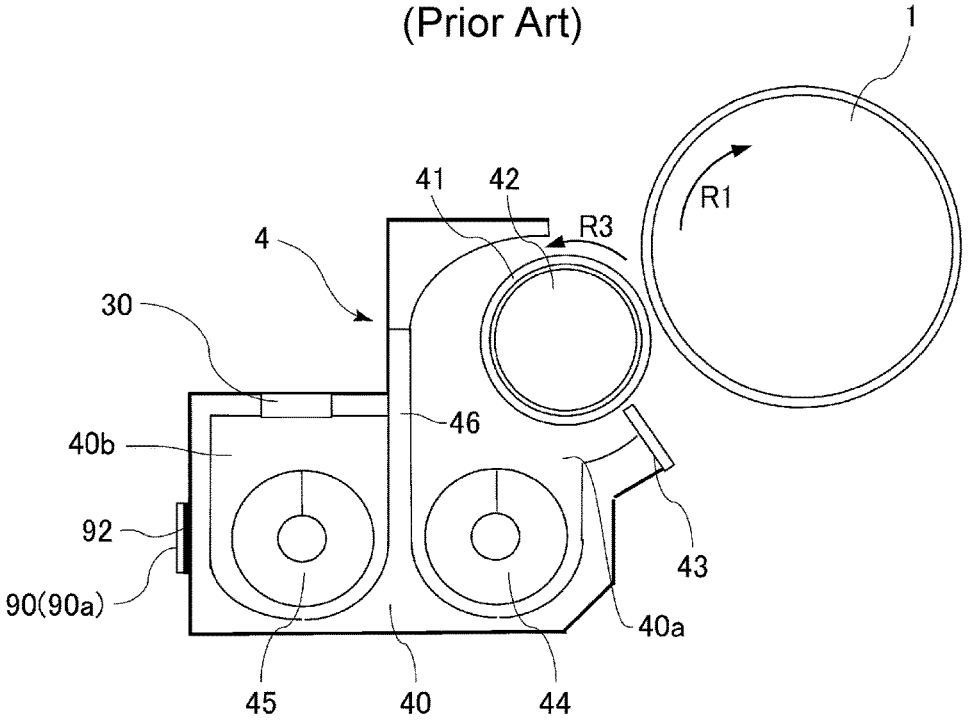
Fig. 13 (Prior Art)
FIG. 13 is a sectional view for illustrating a sensor arrangement in a developing device in Conventional Example 2.

As described above, also in the conventional developing device, in order to acquire the toner content of the developer, the inductance sensor 90 is used. However, in the conventional developing device, it was difficult to properly detect the toner content by using the inductance sensor 90. This will be described using FIGS. 12 and 13. FIG. 12 is a sectional view for illustrating an arrangement of the inductance sensor 90 in a developing device in Conventional Example 1, and FIG. 13 is a sectional view for illustrating an arrangement of the inductance sensor 90 in a developing device in Conventional Example 2.

Conventional Example 1

In the case of Conventional Example 1 shown in FIG. 12, the inductance sensor 90 is provided along an inner wall surface of the developing container 40 in the stirring chamber 40*b* so as to oppose the stirring screw 45 in a downstream side with respect to a developer feeding direction of the stirring screw 45. Further, the inductance sensor 90 is provided so that one surface of the detecting portion 90*a* where the planar coil 92 is formed faces an inside (the stirring screw 45 side) of the developing container 40 so that the planar coil 92 contacts the developer in the developing container 40. In this case, the developer is liable to stagnate between the planar coil 92 of the inductance sensor 90 and the stirring screw 45, so that an immovable layer of the developer is liable to be formed. For that reason, in the case of Conventional Example 1, only at a position where replacement of the developer does not readily generate, i.e., at a position where flowability of the developer is low, a change in magnetic field can be detected, and therefore it was difficult to properly detect the toner content.

Conventional Example 2

In the case of Conventional Example 2 shown in FIG. 13, the inductance sensor 90 is provided on an outer wall surface of the stirring chamber 40*b* of the developing container 40 so that the planar coil 92 does not contact the developer in the developing container 40. Further, the inductance sensor 90 is provided so that one surface of the detecting portion 90*a* where the planar coil 92 is formed faces the developing container 40. This is because it is difficult to detect the change in magnetic field due to permeability of the developer when the magnetic field generated by the planar coil 92 does not have the influence on the developer in the stirring chamber 40*b*. Therefore, in the case of Conventional Example 2, it is preferable that a current larger than the current in Conventional Example 1 is caused to flow through the planar coil 92 so that the magnetic field generated by the planar coil 92 has the influence on the developer in the stirring chamber 40*b* and thus a stronger magnetic field is generated although it varies depending on a thickness of the wall of the developing container 40. However, when the stronger magnetic field is generated in the case of Conventional Example 2, the developer is liable to be influenced by an external magnetic field generated from an unshown power source, a member using a magnetic material and the like which are disposed in the neighborhood of the developing device 4, so that detection accuracy of the sensor is liable to lower.

Further, in either case of Conventional Examples 1 and 2, the change in magnetic field is detected only at one surface of the detecting portion 90*a*. In this case, when compared with the change in magnetic field is detected at both surfaces (both sides) of the detecting portion 90*a*, an amount of the developer having the influence on the magnetic field is liable to lower, and therefore detection sensitivity of the sensor is liable to lower.

First Embodiment

On the other hand, in the developing device 4 in this embodiment, the inductance sensor 90 is provided so that the change in magnetic field can be detected at both surfaces (both sides) of the detecting portion 90*a*, i.e., the planar coil 92. In this embodiment, as regards the inductance sensor 90, the detecting portion 90*a* where the planar coil 92 is formed is disposed in the developing container 40, while a circuit portion 90*b* electrically connected with the planar coil 92 is disposed outside the developing container 40. In the following, an arrangement of the inductance sensor 90 in the developing device 4 in this embodiment, particularly an arrangement of the detecting portion 90*a* will be described using FIGS. 3 and 9.

Figure 9:
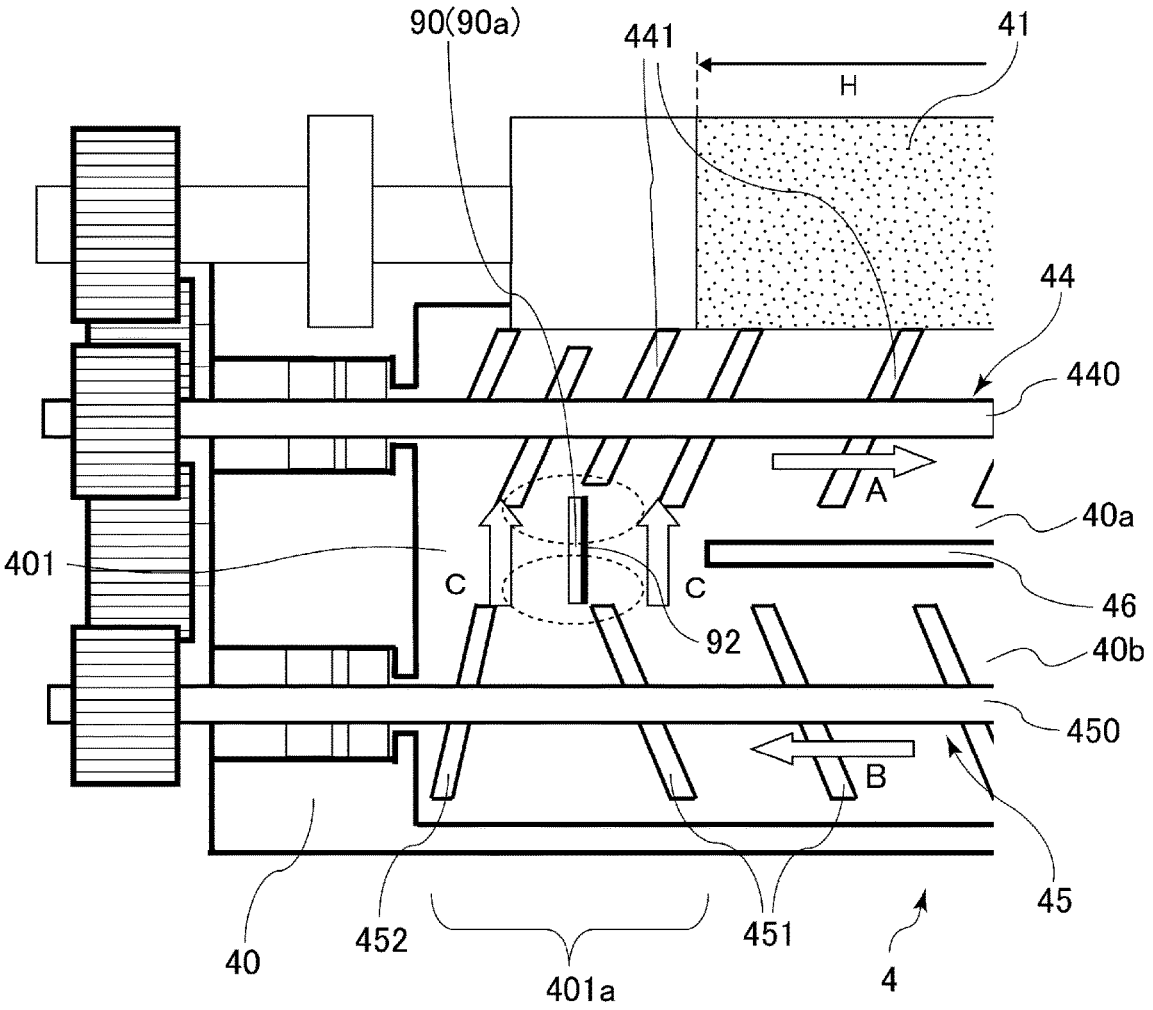
FIG. 9 is an enlarged top view showing a part of a developing device in a First Embodiment.

As shown in FIG. 9, the developing screw 44 is provided with a first helical blade 441, formed around a rotation shaft 440, for feeding the developer in an arrow A direction in the figure. On the other hand, the stirring screw 45 is provided with a second helical blade 451, formed around a rotation shaft 450, for feeding the developer in an arrow B direction in the figure. For example, the developing screw 44 and the stirring screw 45 are formed so that each of diameters of the rotation shafts 440 and 450 is 5 mm. Further, the screws 44 and 45 are formed so that each of outer diameters of the first and second helical blades 441 and 451 is 16 mm and each of screw pitches thereof is 15 mm. At a most downstream portion of the stirring screw 45 with respect to the developer feeding direction, a helical returning blade 452 for pushing back the developer in a direction opposite to the arrow B direction in the figure is provided with an interval between itself and the second helical blade 451. By the second helical blade 451 and the helical returning blade 452, the developer fed in the stirring chamber 40*b* in the arrow B direction is changed in direction to an arrow C direction (direction perpendicular to the developer feeding direction of the stirring screw 45) in a communication region 401*a*. The communication region 401*a* is a region, of a circulation path in a range in which a first communicating portion 401 is formed with respect to the developer feeding direction of the stirring screw 45, and the developer is fed in the communication region 401*a* and is delivered from the stirring chamber 40*b* to the developing chamber 40*a*. Incidentally, the first communicating portion 401 is formed out of a range of a coating region (developer carrying region) H where the developing sleeve 41 is capable of carrying the developer.

In this embodiment, the inductance sensor 90 is provided so that the detecting portion 90*a* (specifically the planar coil 92) is disposed in the communication region 401*a*. The detecting portion 90*a* is disposed so as to contact the developer passing through the communication region 401*a* in a direction crossing the developer feeding direction of the stirring screw 45 at both surfaces thereof. The detecting portion 90*a* projects from, e.g., a bottom or an upper surface of the developing container 40 toward the communication region 401*a*. In this embodiment, a crossing angle between the detecting portion 90*a* and the developer feeding direction is 90°, but may preferably be in a range of 45°-90°.

As shown in FIG. 3, the detecting portion 90*a* is disposed between axes with an interval (indicated by L in the figure), between a first rectilinear line and a second rectilinear line which pass through the rotation shafts 440 and 450 in a vertical direction, with respect to a widthwise direction (direction crossing the developer feeding direction of the stirring screw 45). Further, with respect to the vertical direction of the developing container 40, the detecting portion 90*a* is disposed below an upper end portion of the stirring screw 45 and may preferably be disposed between the upper end portion of the stirring screw 45 and a rotation center of the rotation shaft 450. As a result, the detecting portion 90*a* can be maintained at both surfaces thereof in a buried state in the developer fed in the developing container 40 and even when the detecting portion 90*a* projects, an immovable layer of the developer is not readily formed. For that reason, the developer is capable of contacting both surfaces of the detecting portion 90*a* in a state in which flowability is high and a bulk density is constant.

Further, as shown in FIG. 9, with respect to a longitudinal direction (rotational axis direction of the stirring screw 45) of the developing container 40, the detecting portion 90*a* is disposed between a downstream end of the second helical blade 451 with respect to the developer feeding direction and the helical returning blade 452. In this case, the detecting portion 90*a* may preferably be disposed so that at least a part thereof overlaps with the second helical blade 451 as seen in the rotational axis direction of the stirring screw 45. As a result, the developer easily flows toward not only the surface of the developer in a side close to the partition wall 46 but also the surface of the developer in a side remote from the partition wall 46. As a result, the bulk density of the developer passing through one surface side of the detecting portion 90*a* close to the partition wall 46 and the bulk density of the developer passing through the other surface side of the detecting portion 90*a* remote from the partition wall 46 can be made substantially the same, and flowability of the developer can easily be ensured at both surfaces (both sides) of the detecting portion 90*a*.

When the toner content of the developer is detected, the current is caused to flow from the power source connected with a connector 93 to the planar coil 92 via the circuit portion 90. Then, as shown by broken lines in FIG. 9, the planar coil 92 generates the magnetic field on the both sides of the detecting portion 90*a*. The developer passes through the communication region 401*a* on the both sides of the detecting portion 90*a* while crossing the magnetic field, and therefore the detecting portion 90*a* can detect the change in magnetic field depending on the permeability of the developer at both surfaces of the detecting portion 90*a*.

As described above, in this embodiment, in the case where the inductance sensor 90 is provided, the detecting portion 90*a* is disposed in the communication region 401*a* so that the detecting portion 90*a* contacts the developer passing through the communication region 401*a* at both surfaces thereof. Further, the inductance sensor 90 is disposed so that the detecting portion 90*a* extends along the direction crossing the developer feeding direction of the stirring screw 45, in other words, extends along a movement direction of the developer passing through the communication region 401*a*. As a result, the developer contacts both surfaces of the detecting portion 90*a* in the state in which the flowability is high and the bulk density is constant, an amount of the developer to be detected increases, so that the detection sensitivity and detection accuracy of the sensor can be enhanced. Further, the detecting portion 90*a* is disposed in the communication region 401*a* before the developer is supplied to the developing sleeve 41, and therefore the developer which is relatively small in fluctuation of the permeability due to the toner supply and the toner consumption is capable of being detected. This also contributes to improvement in detection sensitivity and detection accuracy.

Figure 10:
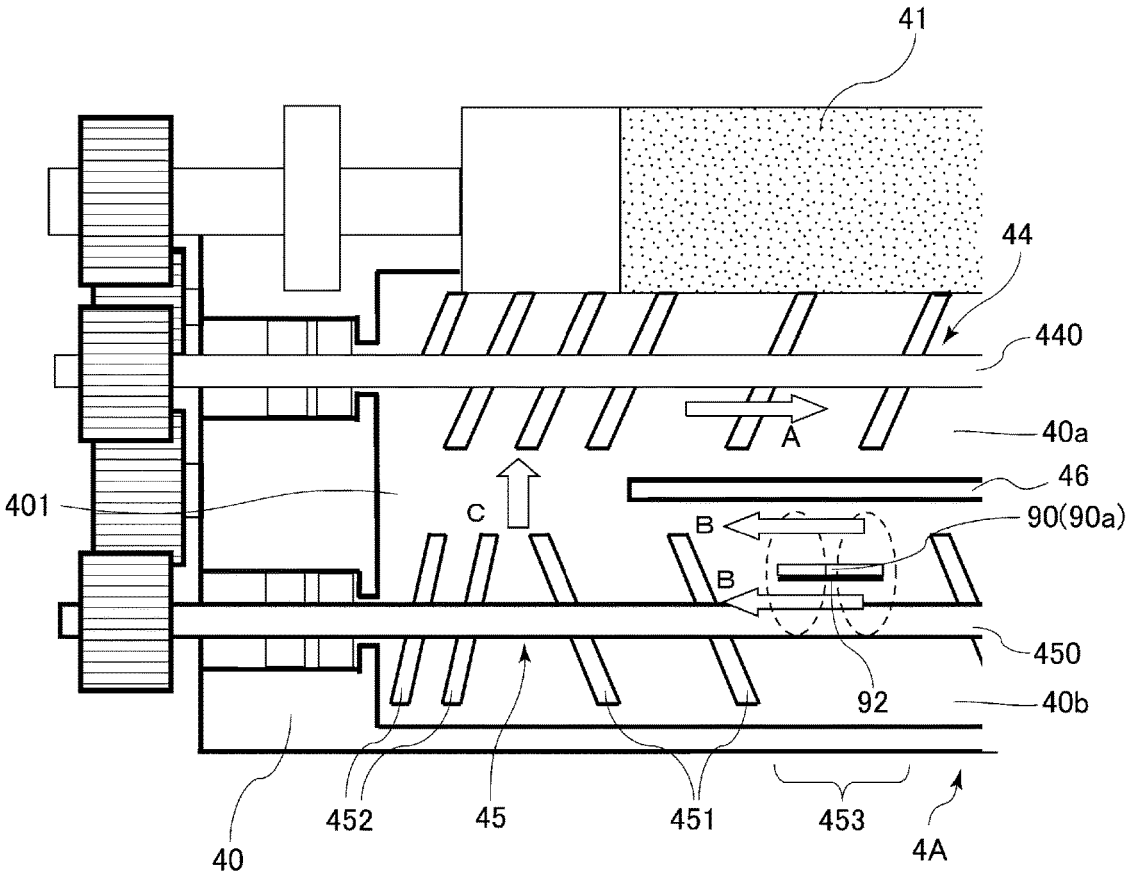
FIG. 10 is an enlarged top view showing a part of a developing device in a Second Embodiment.

An arrangement of an inductance sensor 90 particularly a detecting portion 90*a* in a developing device 4A in this embodiment will be described using FIG. 10. In this embodiment shown in FIG. 10, compared with the above-described First Embodiment (FIG. 9), only the arrangement of the detecting portion 90*a* of the inductance sensor 90 is different from that in the First Embodiment, and other constitutions and functions are similar to those in the First Embodiment. For that reason, the same constituent elements are represented by the same reference numerals or symbols and will be omitted from description and illustration or simplified, and in the following, a difference from the First Embodiment will be principally described.

In this embodiment, the inductance sensor 90 is provided so that the detecting portion 90*a* (specifically the planar coil 92) is disposed in the stirring chamber 40*b* at a position downstream of a center of the partition wall with respect to the developer feeding direction of the stirring screw 45. Further, the detecting portion 90*a* is disposed so that both surfaces (both sides) thereof extend along the developer feeding direction of the stirring screw 45 and contact the developer fed in the stirring chamber 40*b*. The detecting portion 90*a* projects, e.g., from a bottom or an upper surface of the developing container 40 toward the stirring chamber 40*b*. The detecting portion 90*a* is disposed along the stirring screw 45. In this embodiment, a crossing angle between the detecting portion 90*a* and the developer feeding direction of the stirring screw 45 is in a range of 0°-20°.

As shown in FIG. 10, with respect to the widthwise direction (direction crossing the developer feeding direction of the stirring screw 45) of the developing container 40, the detecting portion 90*a* is disposed in the partition wall 46 side of the stirring chamber 40*b*. In this embodiment, the partition wall 46 is provided in a side where the second helical blade 451 of the stirring screw 45 rotates from below toward above in the vertical direction (FIG. 3). Thus, the detecting portion 90*a* is disposed in the partition wall 46 side where a surface of the developer in the stirring chamber 40*b* readily becomes high, so that the both surfaces of the detecting portion 90*a* can be kept in a buried state in the developer fed in the stirring chamber 40*b*.

The stirring screw 45 is provided with a cut-away portion 453 consisting only of the rotation shaft 450, where the second helical blade 451 is cut away, at a position opposing the detecting portion 90*a*. At a position opposing the cut-away portion 453, the detecting portion 90*a* is disposed in a side (rotation shaft side) closer to the rotation shaft 450 than an outer edge portion of the second helical blade 451 is with respect to the widthwise direction crossing the developer feeding direction of the stirring screw 45. This is because in the neighborhood of the detecting portion 90*a*, there is a need that the developer is passed at a flowing speed of a predetermined value or more. That is, in general, in an outer peripheral surface side remote from the rotation shaft 450 of the stirring screw 45, compared with an inner peripheral surface side close to the rotation shaft 450, a developer feeding force is weakened. When the developer feeding force is weakened particularly at a position where the surface of the developer is high, at the position, the developer cannot be passed at the flowing speed of the predetermined value or more, so that the developer is liable to stagnate. In the case of this embodiment, it is difficult to ensure the flowability of the developer particularly in one surface side of the detecting portion 90*a* close to the partition wall 46, with the result that the toner content cannot be properly detected. Therefore, in order to ensure the flowability of the developer by causing the developer to pass through both sides of the detecting portion 90*a* to the extent possible, the detecting portion 90*a* is disposed closer to the rotation shaft 450 side than the outer edge portion of the second helical blade 451 is. By employing the above-described constitution, the developer can contact both surfaces of the detecting portion 90*a* in a state in which flowability is high and the bulk density is constant. This is because in the neighborhood of the detecting portion 90*a*, there is a need that the developer is passed at a flowing speed of a predetermined value or more. That is, in general, in an outer peripheral surface side remote from the rotation shaft 450 of the stirring screw 45, compared with an inner peripheral surface side close to the rotation shaft 450, a developer feeding force is weaken. When the developer feeding force is weaken particularly at a position where the surface of the developer is high, at the position, the developer cannot be passed at the flowing speed of the predetermined value or more, so that the developer is liable to stagnate. In the case of this embodiment, it is difficult to ensure the flowability of the developer particularly in one surface side of the detecting portion 90*a* close to the partition wall 46, with the result that the toner content cannot be properly detected. Therefore, in order to ensure the flowability of the developer by causing the developer to pass through the both sides of the detecting portion 90*a* to the extent possible, the detecting portion 90*a* is disposed closer to the rotation shaft 450 side than the outer edge portion of the second helical blade 451 is. By employing the above-described constitution, the developer can contact the both surfaces of the detecting portion 90*a* in a state in which flowability is high and the bulk density is constant.

As described above, in this embodiment, in the case where the inductance sensor 90 is provided, the detecting portion 90*a* is disposed in the stirring chamber 40*b* so that the both surfaces of the detecting portion 90*a* contact the developer fed in the stirring chamber 40*b*. In this case, the detecting portion 90*a* is disposed so as to extend along the developer feeding direction of the stirring screw 45, i.e., so as to extend along principal flow of the developer fed in the stirring chamber 40*b*. As a result, an effect such that the detection sensitivity and detection accuracy of the sensor can be enhanced similarly as in the above-described First Embodiment can be obtained.

OTHER EMBODIMENTS

Figure 11:
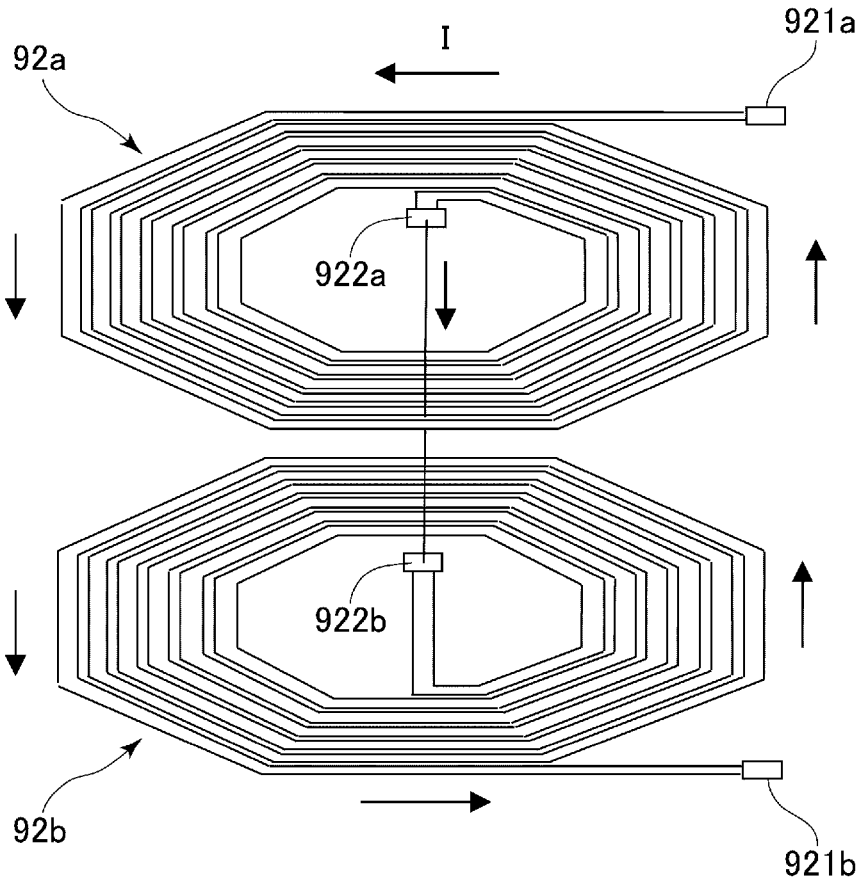
FIG. 11 is a schematic view showing a planar coil of a sensor of a both surface (side) type.

In the above-described First and Second Embodiments, as the inductance sensor 90, the sensor of one-surface type in which the planar coil 92 is formed on one surface of the printed board 91 was used, but the present invention is not limited thereto. A sensor of both-surface type in which the planar coil 92 is formed on both surfaces of the printed board 91 may also be used. FIG. 11 shows a planar coil of the sensor of both-surface type. Incidentally, in FIG. 11, a planar coil 92*a* and a planar coil 92*b* formed on both surfaces of the detecting portion 90*a* (FIG. 5) are shown in a developed state in the same plane.

As shown in FIG. 11, in the case of the sensor of both-surface type, the planar coil 92*a* and the planar coil 92*b* are formed on both surfaces of the printed board 91 by a print pattern. That is, the planar coil 92*a* is formed on one surface of the detecting portion 90*a* of the printed board 91, and the planar coil 92*b* is formed on the other surface of the detecting portion 90*a*. The planar coil 92*a* and the planar coil 92*b* are electrically connected with each other at end portions 922*a* and 922*b*. For that reason, when the current is caused to flow into the planar coil 92*a* through the end portion 921*a*, the current also flows into the planar coil 92*b* through the planar coil 92*a*. When the current flows through the planar coils 92*a* and 92*b*, the magnetic field generates in each of the planar coils. As shown in FIG. 11, in the case where the planar coils 92*a* and 92*b* are formed in a counterclockwise helical shape, directions of the magnetic fields generated in the planar coils 92*a* and 92*b* are the same direction toward the front side in the figure. That is, the sensor of the both-surface type provides the magnetic field stronger than that of the sensor of the one-surface type. As a result, the detection sensitivity of the sensor can be easily improved without changing a size of the sensor.

In the above-described First and Second Embodiments, as the inductance sensor 90, the sensor including the detecting portion 90*a* and the circuit portion 90*b* on the single printed board 91 was used (FIG. 5), but the present invention is not limited thereto. For example, a constitution in which the detecting portion 90*a* and the circuit portion 90*b* are formed on separate substrates and these two substrates are connected by a connector or the like to prepare an inductance sensor may also be employed. In this case, the inductance sensor can be provided in a state in which the detecting portion 90*a* is formed separately from the circuit portion 90*b*, and therefore arrangement of the detecting portion 90*a* and the circuit portion 90*b* can be made relatively freely.

As regards the inductance sensor 90, a cross-sectional shape is not limited to a rectangular shape but may also be an elliptical shape or a curved shape. In such a case, the flow of the developer is not readily prevented, so that flowability of the developer is easily ensured.

In the case of the First Embodiment, the arrangement of the detecting portion 90*a* is not limited to that in the first communicating portion 401 side, but may also be that in the second communicating portion 402 side. However, the arrangement of the detecting portion 90*a* in the first communicating portion 401 side before the developer is supplied to the developing sleeve 41 is preferred from the viewpoint of the improvement in detection sensitivity and detection accuracy as described above.

In the case of the Second Embodiment, the arrangement of the detecting portion 90*a* is not limited to that in the partition wall 46 side, but may also be that in a side opposite from the partition wall 46 with respect to the stirring screw 45. However, the arrangement of the detecting portion 90*a* in the partition wall 46 side where the surface of the developer is at a high level is preferred since the detecting portion 90*a* can be easily contacted to the developer in a state in which the flowability is high and the bulk density is constant.

In the above-described First and Second Embodiments, the image forming apparatus 100 of the intermediary transfer type in which the toner images are primary-transferred from the photosensitive drums 1Y to 1K onto the intermediary transfer belt 12 and then the composite color toner images are secondary-transferred collectively onto the recording material P was described, but the present invention is not limited thereto. For example, an image forming apparatus of a direct transfer type in which the toner images are directly transferred from the photosensitive drums 1Y to 1K onto the recording material P carried and fed by a transfer material feeding belt may also be used.

In the above-described First and Second Embodiments, the developing device of the horizontal stirring type in which the developing container 40 is partitioned horizontally into the developing chamber 40*a* and the stirring chamber 40*b*, but the present invention is not limited thereto. For example, the above-described First and Second Embodiments are also applicable to a developing device of a vertical stirring type in which the developing container 40 is partitioned vertically into the developing chamber 40*a* and the stirring chamber 40*b*.

Incidentally, the developing screw 44 and the stirring screw 45 may only be required so as to partly overlap with each other as seen in the horizontal direction. Further, for example, the developing chamber 40*a* and the stirring chamber 40*b* may preferably be disposed with a level difference as seen in the horizontal direction so that a bottom portion of the stirring chamber 40*b* is disposed above or below a bottom portion of the developing chamber 40*a*. In this case, when the bottom portion of the developing chamber 40*a* and the bottom portion of the stirring chamber 40*b* in the communication region 401*a* form a series of inclined bottom portions, such an arrangement is preferred since the flowability of the developer is further easily ensured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-040381 filed on Mar. 2, 2016, which is hereby incorporated by reference herein in its entirety.

What is claimed is:

1. A developing device comprising:

a rotatable developer carrying member configured to carry a developer containing non-magnetic toner and a magnetic carrier;

first and second chambers configured to accommodate the developer supplied to said developer carrying member;

a first rotatable feeding member provided in said first chamber and configured to feed the developer in a first direction;

a second rotatable feeding member provided in said second chamber and configured to feed the developer in a second direction opposite to the first direction;

a first communication port configured to permit feeding of the developer from said second chamber to said first chamber;

a second communication port configured to permit feeding of the developer from said first chamber to said second chamber; and a toner content detecting portion including a planar detecting surface including at least a planar coil generating a magnetic field and configured to detect the toner content, wherein said detecting surface is provided in said first communication port above a bottom of said first communication port with respect to a vertical direction, and wherein said detecting surface is disposed substantially in a central portion of said first communication port with respect to the second direction.

2. A developing device according to claim 1, wherein said first chamber accommodates the developer supplied to said developer carrying member.

3. A developing device according to claim 1, further comprising a partition wall configured to form said first and second communication ports and configured to partition said first and second chambers.

4. A developing device according to claim 2, wherein said planar coil is provided below an upper end portion of said second rotatable feeding member with respect to a vertical direction.

5. A developing device according to claim 1, wherein said first rotatable feeding member is a first feeding screw provided with a first helical blade on a rotation shaft thereof, wherein said second rotatable feeding member is a second feeding screw including a second helical blade provided on a rotation shaft thereof and configured to feed the developer in a developer feeding direction opposite to that of said first feeding screw and including a returning blade positioned downstream of said second helical blade with respect to the developer feeding direction and configured to feed the developer in a developer feeding direction identical to that of said first feeding screw, and wherein said planar coil is provided between said second helical blade and said returning blade with respect to a rotational axis direction of said second feeding screw.

6. A developing device according to claim 5, wherein said planar coil is provided so that at least a part thereof overlaps with said second helical blade as seen in the rotational axis direction of said second feeding screw.

7. A developing device according to claim 1, wherein said planar coil is formed by printed wiring of a lead wire on a substrate.

8. A developing device according to claim 1, wherein said detecting surface includes an LC oscillation circuit.

9. A developing device comprising:

a rotatable developer carrying member configured to carry a developer containing non-magnetic toner and a magnetic carrier;

a first chamber configured to accommodate the developer supplied to said developer carrying member;

a second chamber configured to accommodate the developer circulated between said first and second chambers;

a partition wall provided between said first and second chambers;

a first rotatable feeding member provided in said first chamber and configured to feed the developer in a first direction;

a second rotatable feeding member provided in said second chamber and configured to feed the developer in a second direction opposite to the first direction;

a first communication port provided at an end portion of said partition wall and configured to permit feeding of the developer from said second chamber to said first chamber;

a second communication port provided at an opposite end portion of said partition wall and configured to permit feeding of the developer from said first chamber to said second chamber; and a toner content detecting portion provided in said second chamber and including a planar detecting surface having at least a planar coil generating a magnetic field and configured to detect the toner content, wherein said detecting surface is provided along and opposed to said second rotatable feeding member and is disposed at a position such that the developer is fed toward both sides of said detecting surface.

10. A developing device according to claim 9, wherein said second rotatable feeding member is a stirring screw provided with a helical blade which is formed around a rotation shaft thereof and which is configured to feed the developer in a developer feeding direction opposite to that of said first rotatable feeding member, wherein said helical blade has an upper end and a lower end with respect to a direction of gravitation, and wherein said planar coil is provided in a region positioned downstream of the lower end of said helical blade and upstream of the upper end of said helical blade with respect to a rotational direction of said helical blade.

11. A developing device according to claim 10, wherein said stirring screw includes a cut-away portion where said helical blade is cut away, and wherein said planar coil is disposed at a position opposing said cut-away portion in a side where said planar coil is closer to the rotation shaft of said second rotatable feeding member than an outer edge portion of said helical blade is with respect to a widthwise direction crossing the developer feeding direction.

12. A developing device according to claim 9, wherein said detecting surface is disposed downstream of a central portion of said second chamber with respect to the second direction.

13. A developing device according to claim 9, wherein said planar coil is formed by printed wiring of a lead wire on a substrate.

14. A developing device according to claim 9, wherein said detecting surface includes an LC oscillation circuit.

15. A developing device comprising:

a rotatable developer carrying member configured to carry a developer containing non-magnetic toner and a magnetic carrier;

first and second chambers configured to accommodate the developer supplied to said developer carrying member;

a first rotatable feeding member provided in said first chamber and configured to feed the developer in a first direction;

a second rotatable feeding member provided in said second chamber and configured to feed the developer in a second direction opposite to the first direction;

communication ports configured to permit feeding of the developer between said first chamber and said second chamber; and a toner content detector including a planar detecting surface having at least a planar coil generating a magnetic field and configured to detect the toner content, wherein said detecting surface is provided in one of said communication ports at a position above a bottom of said communication port with respect to a vertical direction, and wherein said detecting surface is disposed in a central portion of said one communication port so as to allow flow of the developer on both vertical sides of said toner content detector.

16. A developing device comprising:

a rotatable developer carrying member configured to carry a developer containing non- magnetic toner and a magnetic carrier;

a first chamber configured to accommodate the developer supplied to said developer carrying member;

a second chamber configured to form a circulation path of the developer circulated between said first chamber and second chamber;

a communicating portion configured to deliver the developer between said first chamber and said second chamber; and a toner content detecting portion including a printed board, a planar coil which is formed on said printed board and which generates a magnetic field, and a circuit portion which is formed on said printed board and which forms an LC circuit with said planar coil by being electrically connected with said planar coil, wherein said planar coil is disposed in one of said second chamber and said communicating portion.

17. A developing device comprising:

a rotatable developer carrying member configured to carry a developer containing non- magnetic toner and a magnetic carrier;

a first chamber configured to accommodate the developer supplied to said developer carrying member;

a second chamber configured to form a circulation path of the developer circulated between said first chamber and second chamber;

a communicating portion configured to deliver the developer between said first chamber and said second chamber; and a toner content detecting portion including a printed board, a planar coil which is formed on said printed board and which generates a magnetic field, and a circuit portion which is formed on said printed board and which forms an LC circuit with said planar coil by being electrically connected with said planar coil, wherein said toner content detecting portion is disposed in one of said second chamber and said communicating portion.

* * * * *